US009249380B2

(12) United States Patent
Gordon et al.

(10) Patent No.: US 9,249,380 B2
(45) Date of Patent: Feb. 2, 2016

(54) DOSAGE FORM DETERGENT PRODUCTS

(75) Inventors: James William Gordon, Cumbria (GB); Steven Hedley Holden, Cumbria (GB)

(73) Assignee: ROBERT MCBRIDE LTD., Manchester (GB)

( * ) Notice: Subject to any disclaimer, the term of this patent is extended or adjusted under 35 U.S.C. 154(b) by 0 days.

(21) Appl. No.: 13/388,608

(22) PCT Filed: Jul. 30, 2010

(86) PCT No.: PCT/GB2010/001450

§ 371 (c)(1),
(2), (4) Date: Feb. 2, 2012

(87) PCT Pub. No.: WO2011/015810

PCT Pub. Date: Feb. 10, 2011

(65) Prior Publication Data

US 2012/0129748 A1 May 24, 2012

(30) Foreign Application Priority Data

Aug. 7, 2009 (GB) ..... 0913808.2

(51) Int. Cl.
*C11D 17/04* (2006.01)
*C11D 11/00* (2006.01)

(52) U.S. Cl.
CPC ..... *C11D 17/042* (2013.01)

(58) Field of Classification Search
USPC ..... 510/224, 296, 298, 439
See application file for complete search history.

(56) References Cited

U.S. PATENT DOCUMENTS

| | | | | |
|---|---|---|---|---|
| 5,132,036 | A | 7/1992 | Falou et al. | |
| 6,730,646 | B1 * | 5/2004 | Waschenbach et al. | 510/224 |
| 7,229,955 | B2 | 6/2007 | Dasque et al. | |
| 2002/0006890 | A1 | 1/2002 | Sunder et al. | |
| 2003/0224959 | A1 * | 12/2003 | Smith | 510/295 |
| 2004/0118711 | A1 * | 6/2004 | Duffield | 206/219 |
| 2005/0119153 | A1 | 6/2005 | Burt et al. | |
| 2006/0016715 | A1 | 1/2006 | Fregonese et al. | |
| 2007/0004612 | A1 * | 1/2007 | Catlin et al. | 510/295 |
| 2008/0014392 | A1 | 1/2008 | Ayats et al. | |
| 2008/0248989 | A1 * | 10/2008 | Holderbaum et al. | 510/445 |

FOREIGN PATENT DOCUMENTS

| | | |
|---|---|---|
| DE | 10233564 | 10/2003 |
| EP | 0 530 870 | 3/1993 |

(Continued)

OTHER PUBLICATIONS

International Search Report for PCT/GB2010/001450 mailed Nov. 23, 2010.

*Primary Examiner* — Lorna M Douyon
(74) *Attorney, Agent, or Firm* — Nixon & Vanderhye P.C.

(57) ABSTRACT

A method of producing a dosage form detergent product, comprises the steps of: (a) producing an open-mouthed pouch by forming a water-soluble, synthetic plastics film into a mould cavity defining the pouch, (b) introducing a particulate first detergent composition into the pouch, (c) forming a recess in the upper surface of the particulate first detergent composition, (d) introducing into the recess a pre-formed, shape-retaining second detergent component with an at least substantially planar face positioned to be exposed from the particulate first detergent component, and (e) sealing a water-soluble film over the mouth of the pouch and against the exposed face of the pre-formed detergent product.

18 Claims, 4 Drawing Sheets

(56) References Cited

FOREIGN PATENT DOCUMENTS

| | | | |
|---|---|---|---|
| EP | 0 544 440 | | 6/1993 |
| EP | 0 976 819 | | 2/2000 |
| EP | 0976819 | | 2/2000 |
| EP | 1 134 281 | | 9/2001 |
| EP | 1 647 494 | | 4/2006 |
| EP | 1 650 290 | | 4/2006 |
| EP | 1650290 | | 4/2006 |
| EP | 1 669 438 | | 6/2006 |
| EP | 1 705 239 | | 9/2006 |
| EP | 1705239 | | 9/2006 |
| EP | 1 741 774 | | 1/2007 |
| GB | 2406338 | | 3/2005 |
| WO | WO 92/20774 | | 11/1992 |
| WO | WO 99/06522 | | 2/1999 |
| WO | WO 99/24548 | | 5/1999 |
| WO | WO 99/24549 | | 5/1999 |
| WO | WO 00/04122 | | 1/2000 |
| WO | WO 00/55415 | | 9/2000 |
| WO | WO 01/36290 | | 5/2001 |
| WO | WO 01/83669 | | 11/2001 |
| WO | WO 02/26926 | | 4/2002 |
| WO | WO 02/42407 | | 5/2002 |
| WO | WO 02/42408 | | 5/2002 |
| WO | WO 02/085736 | | 10/2002 |
| WO | WO 02/085738 | | 10/2002 |
| WO | WO 2004/007314 | | 1/2004 |
| WO | WO 2004/046297 | | 6/2004 |
| WO | WO 2005/105975 | A1 * | 11/2005 |
| WO | WO 2005/121032 | | 12/2005 |
| WO | WO 2005/121302 | | 12/2005 |
| WO | WO 2005/123511 | | 12/2005 |
| WO | WO 2007/033743 | | 3/2007 |
| WO | WO 2008/087424 | | 7/2008 |
| WO | WO 2008/087426 | | 7/2008 |
| WO | WO 2009/056861 | | 5/2009 |

* cited by examiner

DOSAGE FORM DETERGENT PRODUCTS

This application is the U.S. national phase of International Application No. PCT/GB2010/001450 filed 30 Jul. 2010 which designated the U.S. and claims priority to GB 0913808.2 filed 7 Aug. 2009, the entire contents of each of which are hereby incorporated by reference.

The present invention relates to dosage form detergent products, i.e. detergent products which contain a pre-determined total amount of at least one detergent component and which are intended to be added to a laundry washing machine or automatic dishwashing machine to provide that total amount of the detergent component to the washing process. The invention is concerned more particularly with such dosage form products in which the detergent composition is provided within a water-soluble envelope.

Various types of dosage form detergent products have become popular over recent years because they can be added in the "as manufactured" form to a domestic washing machine or dishwashing machine to provide the required amount of detergent component. This avoids the need to measure that amount separately, as is the case where the detergent composition is provided as a free flowing powder in a box or as a liquid in a bottle.

Examples of such dosage forms include tablets formulated for use in a domestic automatic laundry washing machine or a domestic automatic dishwashing machine. Further examples of products in the form of sachets in which the detergent composition is sealed within an envelope of a water-soluble film material, e.g. polyvinyl alcohol. In both types of dosage form, the detergent formulation may comprise a "main body" of particulate detergent composition and a separate, pre-formed insert. In the case of tablets, the main body of particulate detergent composition is formed by compression of the particulate material into tablet form generally with the simultaneous production of a recess in the tablet body. The pre-formed insert is located in (and bonded to) the recess on the tablet body and may itself be comprised of compressed particulate material (e.g. compressed into the form of a sphere or a "lozenge") or alternatively may be in the form of a gel or solidified melt. Examples of such tablets are described in EP-A-0 976 819 disclosing a compressed particulate insert and EP-A-0 960 187 disclosing an insert in the form of a gel or solidified melt.

Water-soluble sachets containing detergent formulations incorporating an insert are described, for example, in WO 2005/121302 A (Reckitt Benckiser). Such sachets are produced by thermoforming a water-soluble thermoplastics material (e.g. polyvinyl alcohol) into a mould cavity ("pocket") having a recess and then locating the insert in the moulded recess of the film prior to filling the thermoformed body with particulate detergent composition and then providing a "lid" in the form of a water-soluble film sealed over the mouth of the pouch.

WO 2009/056861 A (Reckitt Benckiser) relates to similar subject matter and discloses that there is a major problem in thermoforming polyvinyl alcohol film into a pocket in that the film is stretched with the result that, immediately after being thermoformed, the film starts to shrink back away from the mould. This is a particular problem in the case where the mould cavity incorporates a recess since it is difficult to maintain the contours of the corresponding recess moulded into the film. The solution proposed in WO 2009/056861 is to use thicker film. However thicker films take longer to dissolve and can lead to dissolution issues if added to the draw of a laundry washing machine.

A further development is disclosed in WO 2008/087424 (Reckitt Benckiser) which discloses a dosage form product in the form of a sachet (formed of a water-soluble thermoplastics material) enclosing a non-consolidated particulate composition and a gel in direct contact with one another. These dosage form products are for use in a domestic dishwashing machine and may be formed by a process in which a sheet of the water-soluble film is formed into a pouch into which the particulate composition is introduced followed by the step of displacing this particulate composition to form a hollow therein. A gel or gel precursor is then introduced into the hollow in the particulate composition and a top film sealed over the mouth of the pouch. In embodiments of dosage elements described in WO 2008/087424 a further component comprising one or more active washing agents may lie in or on the gel or gel precursor. Such further component may, for example, be in a solid form such as a "pill".

In spite of the above developments, there remains a need for improved dosage form detergent products as well as methods for their production. The present invention addresses that need.

According to a first aspect of the present invention there is provided a method of producing a dosage form detergent product, comprising the steps of:

(a) producing an open-mouthed pouch by forming a water-soluble, synthetic thermoplastics film into a mould cavity defining said pouch,
(b) introducing a particulate first detergent composition into the pouch,
(c) forming a recess in the upper surface of the particulate first detergent composition,
(d) introducing into said recess a pre-formed, shape-retaining second detergent component with an at least substantially planar face positioned to be exposed from the particulate first detergent component, and
(e) sealing a water-soluble film over the mouth of the pouch to lie against said exposed face of the pre-formed detergent product The invention provides a convenient method for the production of detergent dosage forms comprising two (i.e. first and second) detergent components provided within a water-soluble envelope. More particularly, the invention provides for location of the second component in a recess formed (in step (c) defined above) in the particulate first detergent composition. The provision of this recess allows the second component to be located in position without the need for the use of a mould having a cavity formed with a recess therein, such as disclosed in WO 2005/121302 and WO 2009/05686 (see above). In essence, therefore, the recess formed in the particulate first detergent composition in step (c) of the present method replaces the need for a pre-formed recess in a mould cavity and avoids problems associated with maintaining the contour of the moulded recess of the film. In particular, the degree of stretching applied to the sealing film (in step (e) of the process is less than is the case of forming a moulded recess in the pouch, as is the case in prior art constructions, even for the case of preferred embodiments of the invention where the second detergent component projects above the mouth of the pouch. This lesser stretching ensures there is less tendency of the film to "pull-back" (as compared to the prior art pouches with their moulded recesses so shrinkage is less of a problem. For these reasons, the present invention makes it possible to use thinner films than in the procedures of WO 2005/121302 A and WO 2009/056861 A with advantages of more rapid dissolution. The present invention also provides a significant advantage having regard to the procedure of WO 2008/087424 in that because the sealing film lies across the at least substantially planar face of the pre-formed, second detergent component there is resistance to particles in the first detergent component going between that surface and the sealing during operations such as packaging, transport and other handling operations. Due to this feature, the aesthetic appearance of dosage form products produced with a transparent sealing film may be preserved since particulate first detergent component is inhibited from going between the film and the at least substantially planar surface of the second detergent component and spoiling the appearance of the latter, both by virtue of particulate first detergent component appearing on the at least substantially planar surface of the second detergent component and reduce edge definition around the latter.

The invention allows the production of dosage form detergent products which are of robust construction and able to retain their shape during handling operations. This property, i.e. robust structure, is important from a practical point of view in that the dosage form detergent products may be flat-bottomed (or essentially flat-bottomed) sachets which retain their shape and which are ideally suited for location in a standard dispensing compartment of a domestic dishwashing machine.

By the term "at least substantially planar" we mean that any deviation from planarity of the surface is insufficient to provide regions of the surface against which the film does not lie. Thus, for example, any convexity of the surface should not be so large that there is an outer region of the surface which does not lie in contact with the film. Thus, for example, we have found in the case of a disc with a diameter of 16 mm the faces should not have any convexity with a radius less than 30 mm.

The pre-formed detergent component may have a single, at least substantially planar surface but for ease of manufacture of the dosage form detergent products of the invention will more preferably have two such surfaces that are parallel to each other so that the pre-formed detergent component may be located "either way up" in the recess formed in the particulate first detergent component during step (d) of the method of the invention.

The at least substantially planar surface(s) of the pre-form detergent component will generally be the major surface(s) of that component.

In particularly preferred embodiments of the invention, the sealing film locates against an edge bounding the at least substantially planar surface against which the film lies. This contact between the film and the bounding edge assists in preventing movement of the first particulate composition beneath the film. The pre-formed detergent component may have a beveled edge around the at least substantially planar surface, in which case the film preferably lies against at least the inner edge of the bevel (i.e. that edge which defines the boundary of the at least substantially planar surface).

The pre-formed detergent component may, for example, be of circular or polygonal (e.g. triangular, square, rectangular etc) cross-section. The pre-formed detergent component is preferably of uniform cross-section or essentially uniform cross-section throughout its depth. In preferred embodiments of the invention, the pre-formed detergent component is a disk but may, for example, alternatively be of a cuboid structure. Thus a pre-formed detergent component with a beveled edge around its at least substantially planar surface may be considered to be of essentially uniform cross-section. This cross-section may, for example, be circular or polygonal such as triangular, square, rectangular etc.

The pre-formed body may, with preference, be of a compressed particulate material but alternatively may be a shape-retaining, pre-formed body of a gel or solidified melt. It is particularly preferred that the second detergent component consists of compressed particulate material (i.e. there are no second detergent components of other materials, e.g. gel or solidified melt in the recess).

In a preferred implementation of the method of the invention, step (c) in which the recess is formed simultaneously involves compaction of the body of particulate first detergent composition added to the pouch in step (b) of the process. This may simultaneous compaction of the powder with formation of the recess may be effected by a punch tool having a protuberance for forming the recess surrounded by an area of the tool which compacts the powder.

Dosage form detergent products in which the first particulate composition is compacted form an important feature of the present invention in their own right. Therefore a second aspect of the present invention provides a dosage form detergent product comprising:

(i) a water-soluble envelope comprised of a pouch of a water-soluble film and a seal also of a water-soluble film provided across the mouth of the pouch, (ii) a compacted, particulate first detergent composition provided in said pouch and formed with a recess in the surface of the first detergent composition adjacent said seal, and (iii) a second detergent component provided in said recess of the compacted first composition wherein the second detergent component is a pre-formed, shape-retaining body with an at least substantially planar surface in contact with the under surface of the seal.

The pre-formed detergent component for use in the second aspect of the present invention may be as described above for the first aspect.

Whilst it is particularly preferred that the first particulate detergent composition is compacted we do not preclude the possibility of the method of the invention being used to produced dosage form detergent products in which the particulate first composition is provided with a recess but is otherwise uncompacted.

Dosage form detergent products in accordance with the invention may, for example, be for domestic laundering or dishwashing operations.

In the preferred manufacturing process, the recess formed in the particulate first detergent composition has a depth which is equal to or less than the depth of the second detergent component. Preferably the depth of the recess is less than the depth of the second detergent component whereby the at least planar surface of the latter will be located above the surface of the particulate detergent component.

In preferred dosage form detergent products, the at least substantially planar surface of the pre-formed detergent component is urged relatively into contact with the under surface of the sealing film to assist in prevention of movement of particulate first detergent component between the sealing film and the second detergent component. This may be achieved, for example, by producing the pouch from a film which has a lower modulus (e.g. as measured in modulus 100% value) than that used as the sealing film. In other words, the film used for producing the open-mouthed pouch is "more stretchy" than that used for the top film. With this combination, the film forming the pouch is able to push the second detergent component against the under surface of the top film which provides the advantages of helping to retain the second detergent component in place and inhibiting ingress of particulate material between the second detergent component and the under surface of the top film.

Compaction of the first detergent composition in conjunction with the above preferred features of using films of different moduli) serves to improve shape retention in the final product and prevent undesired ingress of particulate material between the second detergent component and the upper film. It will be appreciated that these benefits are obtained since the compaction process helps prevent movement of the particles within the first detergent composition. However similar effects can be achieved by using a first detergent composition in which the particles have some cohesion with each other, e,g. by virtue of the granulometry of the powder or incorporation of "sticky" particles therein.

It should however be noted that compaction pressures used in production of the dosage form detergent products of the invention should not be so high that the particulate, first detergent composition is compacted to a mass which would be "shape-retaining" if the outer film of the product were to be removed. Thus dosage form detergent products in accordance with the invention are such that the particulate first detergent component effectively remains as a free-flowing powder if the outer film is removed and not as a "shape-retaining" tablet.

The particulate, first detergent component is preferably such that when used to manufacture a dosage form detergent product in accordance with the procedure of Example 2 below, the resulting product has a strength (as determined by the test as detailed in Example 2) of at least 4.5 N, more preferably at least 6 N. The test of Example 2 is referred to herein as the "test as herein defined".

Generally the weight amount of the first particulate detergent composition will be at least (and preferably greater than) that of the second detergent composition. Thus, for example, the weight ratio of the first particulate detergent composition to the second detergent composition may be at least 5:1, more preferably 9:1 to 40:1. Typically the weight of second detergent component will be from 0.4 to 5 g, e.g. 0.7 to 1.6 g. The amount of the first particulate detergent component may be calculated accordingly. A typical, but non-limiting example of product in accordance with the invention will be for use in a domestic, automatic dishwashing machine and will comprise 14 g of the first particulate detergent composition and 1 g of the second detergent composition.

The compositions of the first particulate detergent component and the second detergent component will be determined by the intended use of the dosage form product but generally each will contain at least one of a builder (e.g. STP or other type of builder, e.g. zeolite, citrate or MGDA), a surface active agent, a source of alkalinity, bleach, bleach activator, anti-filming polymer, enzyme, softening clay, fabric softness agent, fabric care agent, lubricant, dye or perfume. It is particularly preferred that the second detergent component is of a different colour from the first particulate detergent component 1 and therefore visibly distinct. In one embodiment, the dosage form product may be for use in a domestic laundry washing machine, in which case the particulate first detergent component and the second detergent component may comprise surfactants and in particular those that are solid at 25° C., low temperature bleach activators, softening clays and materials that carry perfume. Alternatively the dosage form product may be intended for use in a domestic automatic dishwashing machine, in which case the particulate first detergent component and the second component may each comprise at least one of a builder, surfactant, bleach activator or dye. Examples of suitable components include TAED, polyacrylate polymers and non-ionic surfactants that are solid at 25° C.

It will be appreciated that the dosage form product of the invention may be one in which performance is enhanced as a result of separation of certain ingredients as between the first and second detergent components.

The second detergent component may dissolve more slowly than the first particulate detergent composition and contain a component which is delivered relatively late in the wash cycle or a domestic laundry or dishwashing machine.

In certain embodiments of the invention, the first, particulate detergent component may include encapsulated agents.

The water-soluble films used for the purposes of steps (a) and (e) of the method of the first aspect of the invention may be the same or different and will generally each have a thickness in the range 25 to 80 μm. The films are preferably such that they totally dissolve in water at a temperature of 10° C. within 2 minutes. It is particularly preferred that the films are of polyvinyl alcohol.

We particularly prefer that the water-soluble film used for providing a seal in step (e) of the process is a blown film as such films tend to stretch less than a cast film and help reduce any lateral movement of the second composition (relative to the first) in the final dosage form product. The film used in step (a) is preferably a cast film.

By way of example, the film used in step (a) of the method for forming the pouch may be Monosol M8630 (30 μm cast film) and the film used for forming the seal in step (e) may be Monosol L711 (30 μm blown film). According to manufacturers data, the M8630 film disintegrates in water at 10° C. in 6 seconds and dissolves in 20 seconds. The corresponding figures for L711 film are 12 and 120 seconds.

Step (a) of the method of the first aspect of the invention for producing dosage form products may comprise a vacuum thermoforming process in which the water-soluble synthetic thermoplastics film is heated and drawn down into the mould cavity (preferably one with a flat base) by vacuum. Whilst vacuum thermoforming represents an advantageous embodiment of the invention there are other possibilities. Although vacuum thermoforming is the preferred technique, the lower the amount of heat the better since this assists the ability of the final dosage form product (e.g. in the form sachet) to retain its shape. For example, the film may be drawn down into the mould cavity using an appropriately high level of vacuum without prior heating of the film. Further examples of techniques which may be used for effecting step (a) of the process are described in WO 2009/056861.

In a subsequent step of the process, the particulate first detergent composition is introduced into the pouch and a recess is formed in the upper surface of the particulate composition for accommodating the second detergent component. As indicated above, this may be effected using a punch tool having a protuberance for forming the recess surrounded by an area of the tool which compacts the powder. Ideally the powder-contacting surfaces of the tool are treated to reduce adhesion thereto by the particulate composition. This may be by way of the use of inserts, in particular those made of elastomers and/or special non-stick surfaces and smooth surfaces. The degree of compaction exerted at this stage should be sufficient that the powder is compacted to the extent that the walls of the recess remain in place at least long enough for the second detergent component to be introduced into the recess. However the degree of compaction need not be so high that the powder remains intact if removed from the pouch or has its dissolution properties significantly impaired.

In the subsequent step of the manufacturing process, the sealing film is sealed over the mouth of the pouch (e.g. by heat sealing or by the application of moisture either to the sealing film and/or the region(s) of the open-mouthed pouch (e.g. a flange therearound) to which the sealing film is to be bonded). Subsequently the dosage form detergent product may be removed from the mould.

For certain embodiments of the invention, it may be desirable to prick or otherwise pierce the sealing film applied in step (e) of the process. This helps to reduce movement of the particulate first detergent component relative to the second component. This embodiment of the invention is particularly useful in the case where the particulate first detergent component is compacted.

The method of the invention may be effected on a horizontal bed production machine (e.g. as manufactured by Harro Hofliger) or a drum based machine (e.g. as manufactured by Cloud Inc.).

BRIEF DESCRIPTION OF THE DRAWINGS

The invention will be further described by way of example only with reference to the accompanying drawings, in which:

As shown in FIG. 1, a dosage form product in accordance with the invention is in the form of a sachet 1 containing compacted particulate material 2 and an insert 3 which sits in a recess 4 formed during compaction of the particulate material 2. Insert 3 is in the form of a disc with an uppermost, planar surface 3*a*. The walls of the sachet 1 are comprised, on the one hand, of a pouch 5 of a thermoformed, water-soluble film material and, on the other hand, a closure element ("lid") 6 also of a water-soluble film material adhered to a flange 7 integrally formed around the upper edge of pouch 2.

Figure 1:
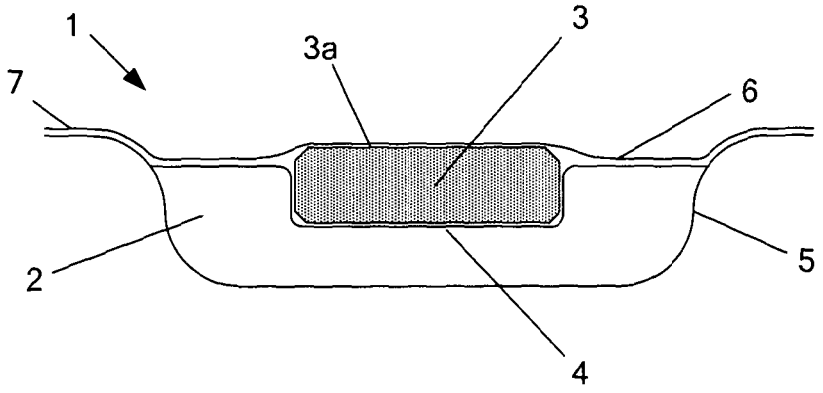
FIG. 1 illustrates one embodiment of dosage form detergent product produced in accordance with the invention.

Furthermore as shown in FIG. 1, the closure film 6 is stretched across the surface 3*a* of the insert 3 and in contact with the bounding edge of that surface. With this arrangement, movement of particles from the particulate material 2 to between the closure film 6 and the surface 3*a* is inhibited, thus providing the advantages discussed more fully above.

The film materials used for forming the pouch 5 and the closure element 6 may be the same or different. These film materials may be of polyvinyl alcohol to provide the requisite water-solubility. Generally speaking, the thickness of the water-soluble film will be in the range 25 to 80 μm although different film thicknesses may be used for the pouch 5 and the closure element 6. By way of example, the pouch 5 may be formed from Monosol M8630 film having a thickness of 38 μm whereas the closure element 6 may be formed from Monosol L711 film (35 μm thickness).

The closure element 6 may be adhered to the flange 7 by heat sealing of the two films together or by use of an adhesive agent.

The water-soluble film materials used for forming the pouch 5 and closure element 6 will generally (but not necessarily) both be transparent so that the contents of the sachet 1 are visible. One or both of the films may be colourless or coloured. Given that the films are transparent, then the insert 3 may be of a contrasting colour to the particulate material 2 for visible effect.

The insert 3 preferably formed of compressed particulate material. It should however be appreciated that the insert 3 may take different forms. Thus, for example, the insert 3 may be of a compressed particulate material but other than a disc. Thus, the insert 3 may for example be any other shape with two parallel, planar faces. The insert may, for example, be cuboid or "lozenge" shaped (i.e. a form having a length somewhat greater than either its width or depth and preferably with rounded ends).

The second composition (particularly if in the form of an insert of a compressed particulate material or of a gel or solidified melt) may dissolve more slowly than the first detergent composition and contain a component which is delivered relatively late in the wash cycle or a domestic laundry or dishwashing machine.

Reference is now made to FIGS. 2-10 which illustrate steps in the production of the sachet 1. For the purposes of simplicity, FIGS. 2-10 illustrate production of only a single sachet but it will be appreciated that many such sachets are formed simultaneously during mass production. For the purposes of mass production either a horizontal-bed or drum-based machine may be used.

Figure 2:
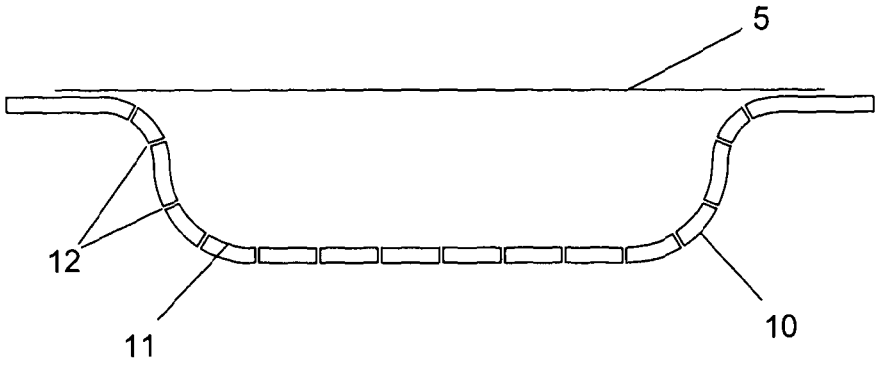
FIGS. 2-10 illustrate steps in the production of the dosage form product illustrated in FIG. 1.
Figure 3:
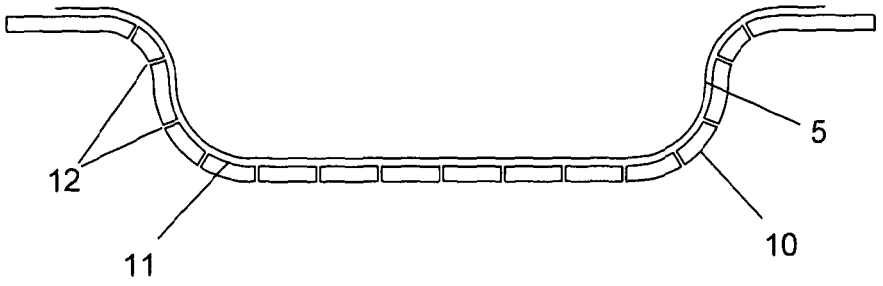

As shown in FIG. 2, a preheated length of water soluble, thermoplastics film 5' (intended for forming the pouch 5) is presented over the mouth of a mould 10 formed with a vacuum moulding cavity 11 having apertures 12 through which suction may be applied. On application of the vacuum, the film 5' is drawn into the mould cavity 11 so as to form the configuration for the pouch 5 including the aforementioned flanges 6 (see FIG. 3).

Figure 4:
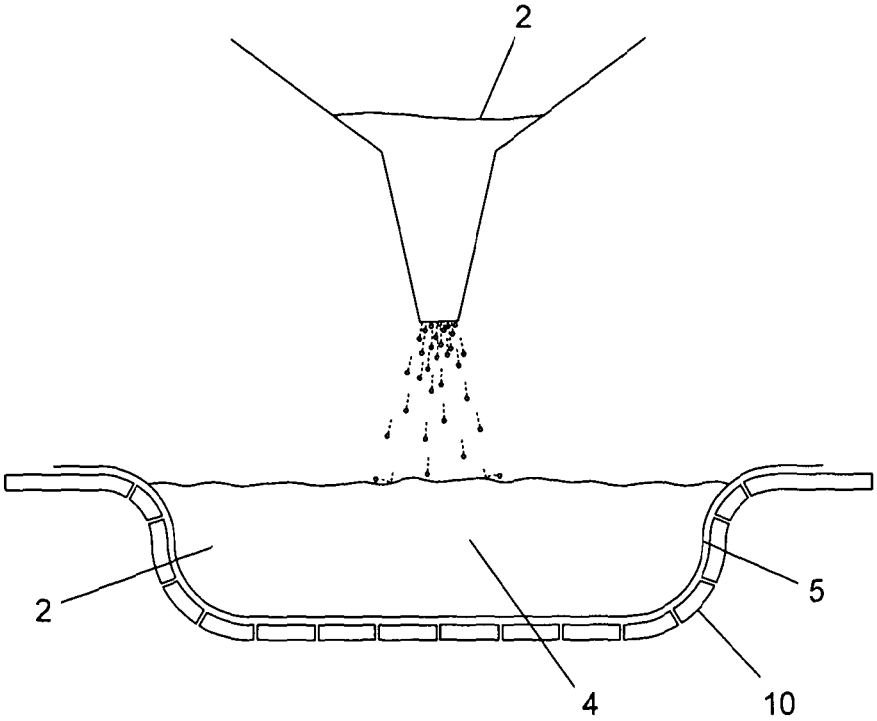

In the next step depicted in FIG. 4, a charge of particulate material 2 is introduced into the (open-mouthed pouch) formed in the previous stage. Typically the amount of particulate material 2 added will be in the region of 60-100% of the volume of the pouch. At this stage, the particulate composition 2 is relatively loose but in the next stage of manufacture (depicted in FIG. 5) is compacted by means of a punch 13 having a plate-like body 14 formed centrally on its undersurface with a generally cylindrical protuberance 15. It is preferred that the punch 13 does not stick to the particulate composition 2 and as such may be treated/modified to reduce adhesion. Techniques familiar to tablet makers may be used for this purpose and include the use of inserts (particularly made of elastomers) and special non-stick surfaces and smooth surfaces.

Figure 5:
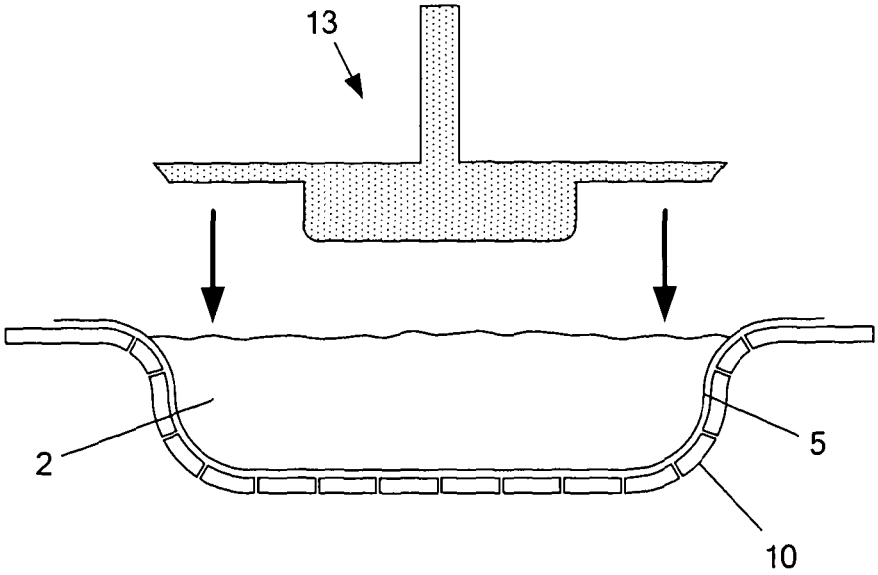
Figure 6:
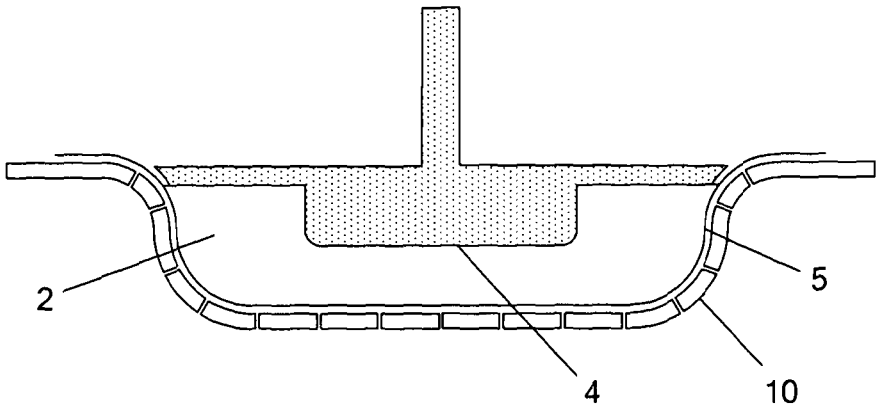

FIG. 5 shows punch 13 in its initial, upper position whereas FIG. 6 shows lowering of the punch 13 so as to compact the particulate material 2 and form the recess 4 therein. The compaction force exerted by the punch 13 may be up to 30 kN, more preferably up to 10 kN. However whatever the compaction pressure it is not envisaged that the powder is compacted to the extent that it would have sufficient integral strength to remain intact if removed from the mould or have its dissolution properties significantly impaired. The compaction force should be great enough that the walls of the recess remain in place at least long enough for the insert 3 to be added.

Figure 7:
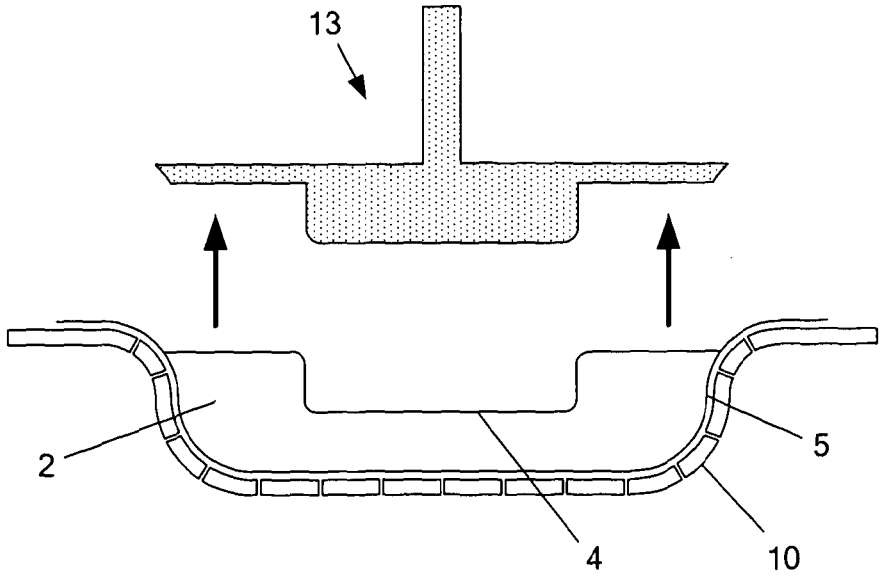

FIG. 7 shows the particulate material 2 after compaction and raising of the punch 13.

Figure 8:
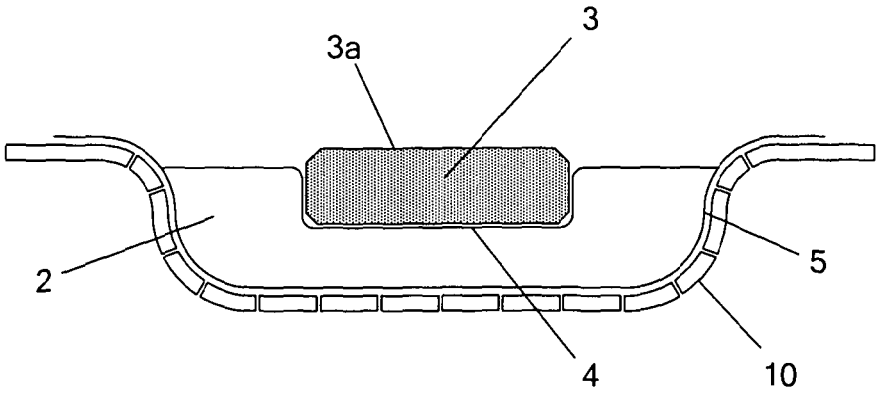
Figure 9:
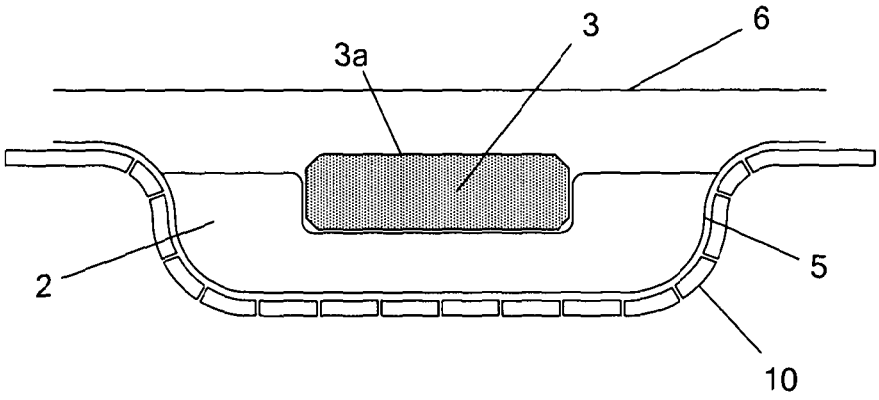
Figure 10:
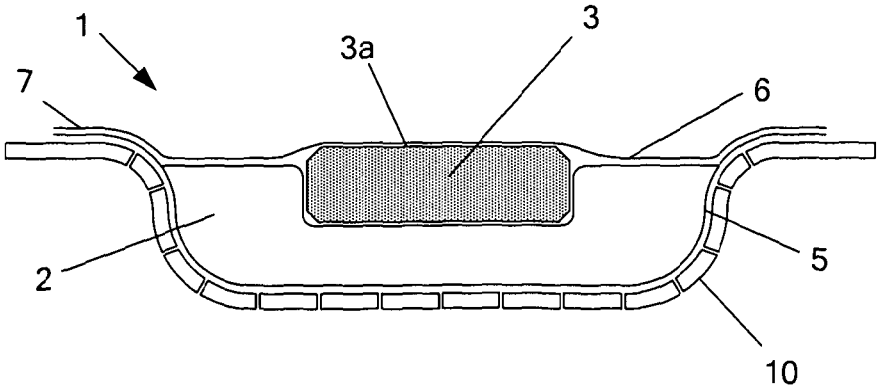

Mould 10 is now moved relatively away from punch 13 so that as depicted in FIG. 8 the insert 3 may be introduced into the recess 4 formed during the aforementioned compaction procedure (FIGS. 6 and 7).

Subsequently, a length of water-soluble, plastics film 6' (which ultimately forms the closure element 6) is of an area capable of overlying both the mouth of the pouch 5 and the flanges 7. Film 6' is brought into contact with the flanges 7 and sealed thereto so as to form the sachet 1. Sealing may be effected by the application of heat or by a light application of steam to film 6' to enhance stickiness. At this stage, the vacuum is released and the sachet 1 may be discharged from the mould 10. In the case of a drum-based machine, the sachet 1 may simply drop out of the mould as the drum rotates. Alternatively or additionally the sachet 1 may be subjected to a vacuum on the upper surface to assist discharge out of the mould 10.

Once the vacuum is released there will be an evening of pressures because the sealing films have been stretched to different degrees and may have different elastic properties. In practice since the first film has been stretched to fill the mould then it will draw back more than the sealing film and cause the sealing film to form a curved surface with the insert 3 sitting on a raised profile located above the seal when looked at from the side.

It should be appreciated that production of the sachet 1 has been shown in a very schematic way which depicts the use of single sheets of the films 5' and 6'. However for the purposes of mass production it will be appreciated that production apparatus will be used which simultaneously forms sachets along the running length of continuous webs and also across the width thereof, the individual sachets subsequently being severed to produce the final article.

The invention is further illustrated by the following non-limiting Examples.

EXAMPLE 1

Monosol M8630 film (30 μm) was heated slightly and stretched across the mouth of a 34×34 mm×14.5 mm deep mould.

Vacuum was applied to draw the film down into the mould cavity. The area of film used was sufficient for the film to be moulded into the form of a pocket in the cavity with a 5 mm rim around the top of the pocket.

Vacuum was maintained whilst 14 g of powder of the following composition was added to fill 90-100% of the volume of the pocket formed by the moulding process.

| | |
|---|---|
| STP | 50% |
| Silicate solution | 1.5% |
| SKS6HDD | 1% |
| Sodium carbonate | 12% |
| Sodium Sulphate | 6.2% |
| Percarbonate | 15% |
| TAED | 3% |
| Protease | 2% |
| Amylase | 1% |
| Benzotriazole | 0.1% |
| Nonionic | 3% |
| Anti-filming polymer | 4% |
| Green beads | 1% |
| Perfume | 0.2% |

An upper punch with a cylindrical protuberance having a diameter of 19.8 mm and a height of 3 mm was pressed down on to the powder with a light compact force (<5 kN) to create a depression 3 mm deep in the powder.

A 1 g disc-like tablet with a diameter of 16 mm, a thickness of 7.2 mm and substantially planar but slightly convex faces (radius of curvature=30 mm) was prepared by compression of the following composition and introduced into the depression:

STP 99%

Dye—0.6%

Lubricant—0.4%

The upper surface of the rim around the pocket was wetted and a sealing film of Monosol L711 (30 μm) was located over the mouth of the pouch and pressed down around the rim to form a seal. The vacuum was released and the sachet removed from the mould.

The shape changed to a more rounded appearance on release of the vacuum but did not change thereafter with the film keeping powder and coretab in place.

Sachets as produced above were evaluated in a Bosch automatic dishwashing machine (model SGS43T72GB/06) running on its 35° C. quick cycle. The dissolution characteristics of sample sachets were measured at 1 minute time intervals and the results are shown in the following Table, it being noted that the sachet had completely dissolved in 9 minutes.

| Time (mins) | Weight (g) |
|---|---|
| 0 | 15.24 |
| 1 | 15.24 |
| 2 | 1.86 |
| 3 | 0.85 |
| 4 | 0.77 |
| 5 | 0.65 |
| 6 | 0.57 |
| 7 | 0.28 |
| 8 | 0.05 |
| 9 | 0 |
| 10 | |

By way of explanation, the weight of 1.86 grams after 2 minutes represented the weight of the tablet plus a remaining "lump" of powder. After 3 minutes only a remnant of the tablet remained.

EXAMPLE 2

This Example demonstrates the effect on sachet appearance and integrity (as measured by a strength test) of using different grades of sodium tripolyphosphate. A series of detergent sachet powders (A-C) of the following general composition were prepared and differed from each other in the particular grade of sodium tripolyphosphate (STP).

| | |
|---|---|
| STP | 53.5% |
| Sodium carbonate | 10.1% |
| Sodium sulphate | 7.8% |
| Sodium percarbonate | 16.1% |
| TAED | 3.2% |
| Enzymes | 2.5% |
| Nonionic C10 EO8 | 3.2% |
| Benzotriazole | 0.1% |
| Zinc salt | 0.1% |
| Sodium silicate solution | 3.2% |
| Dyes/perfume | 0.3% |

The grades of STP used were as follows:

| Composition | STP | % >1000 μm | % >500 μm | % <150 μm |
|---|---|---|---|---|
| A | FH ex Thermphos | 1.24 | 6.59 | 22.15 |
| B | Polypray H ex prayon | 0 | 2.53 | 51.02 |
| C | L400 ex Thermphos | 0 | 8.54 | 1.88 |

1 g tablets in the form of 16 mm diameter discs with a thickness of 5 mm were prepared from the following composition:

| | |
|---|---|
| Acusol 587G | 49.8% |
| Granulated sodium silicate 2.65 ratio | 50% |
| Dye | 0.2% |

Sachets were prepared using bottom and top films as identified more fully below:

(a) The bottom film was a cast polyvinyl alcohol film having a thickness of 38 μm and a modulus 100% (ASTM D882, ISO 527) of 10.3 N $mm^{-2}$ (equivalent to 1500 psi).

(b) The top film was a blown polyvinyl alcohol film with a thickness of 30 μm and a modulus of 33.78 N $mm^{2}$ (4900 psi) in the Machine Direction and 22.75 N $mm^{-2}$ (3300 psi) in the Transverse Direction (ASTM D882, ISO 527).

The sachets were prepared using the following procedure:

1. Place bottom film was placed over the top of a mould having cavity dimensions of 36 mm×33 mm×16.5 mm deep.
2. Heat was applied to the film for 3-5 second using a 2000 W hairdryer (temp 75° C.-80° C.) positioned 5-10 cm from the film.
3. The softened film was drawn down into the mould cavity using a vacuum.
4. Add 14 g of sachet powder (A, B or C as appropriate) were introduced into the pouch formed by the drawn-down film.
5. The powder was pressed using an upper punch with a cylindrical protuberance 3 mm deep with an 17 mm diameter using a force of 1.0-1.4 kN to create a depression in the powder.
6. A tablet was then introduced with a planar surface uppermost into the depression created by the protuberance.
7. The top film was then placed over the mould.
8. The top and bottom films were sealed together around their peripheral edges at 140° C. for 2-3 seconds.
9. The sachet was released from the mould and the edges trimmed.

Sachet strength was measured using an Instron 5544 apparatus fitted with two flat plates using an "end-to-end" crush test with the sachets on their side and measuring along the 33×15 mm side with a test speed of 20 mm $min^{-1}$. The results are shown in the following Table 1.

TABLE 1

| | Sample | | |
|---|---|---|---|
| | A | B | C |
| Sachet Strength | 6.48N | 4.85N | 7.75N |
| Description | Good | Good | Excellent |

EXAMPLE 3

Sachets were prepared using the same procedure as described in Example 2 and the STP as used for Sample C.

The pre-compressed tablets were of the same composition as those used in Example 2 but two shapes were tested for the purposes of this Example. The tablets tested were discs with the following shapes:

Y—16 mm diameter disc with flat faces

Z—16 mm diameter disc with slightly convex faces (radius of curvature=30 mm)

Ten sachets incorporating the tablet Y were dropped sequentially down a vertical 590 mm×75 mm diameter tube into a 210 mm deep plastic bag to simulate the sachets dropping into a pouch during a packaging operation. The sachets were then visually checked to see if powder had managed to cover part of the coretab. The procedure was repeated with a further batch of 10 sachets incorporating tablet Y.

The above procedure as described for sachets containing tablet Y was repeated for sachets containing tablet Z.

The results are shown in Table 2 below which, for each tablet Y and Z, are given as the sum of the two tests.

TABLE 2

| | Perfect | Slight amount of powder | Lot of powder |
|---|---|---|---|
| X | 80% | 15% | 5% |
| Y | 40% | 35% | 25% |

As can be seen, flat tablets where the film is in contact with the tablet rim are preferred as there is a lower tendency for the powder to cover the upper surface of the coretab.

The invention claimed is:

1. A method of producing a dosage form detergent product, comprising the sequence of:

(i) producing an open-mouthed pouch by forming a water-soluble, synthetic plastics film into a mould cavity defining said pouch, (ii) introducing a particulate first detergent composition into the pouch, (iii) forming a recess in the upper surface of the particulate first detergent composition, said forming being effected by a punch tool having a protuberance and a surrounding area for compacting the first detergent composition, (iv) introducing into said recess an insert consisting of a pre-formed, shape-retaining second compressed particulate detergent component with an at least substantially planar face positioned to be exposed from the particulate first detergent component, said second, pre-formed detergent component being in contact with the first detergent component, and (v) positioning a water-soluble film over the insert and sealing the water-soluble film over the mouth of the pouch and against said exposed face of the pre-formed detergent product, wherein any compaction pressure used in production of the product is insufficiently high so that the particulate first detergent composition is compacted to a mass which would not be shape-retaining if the water soluble film of the product were to be removed, and wherein the at least substantially planar surface is urged relatively into contact with the sealing film.

2. The method as claimed in claim 1 wherein the at least substantially planar surface of the second detergent component is bounded by an edge, and wherein in the resulting dosage form detergent component the film used in (v) is in contact with said edge to assist in preventing movement of the first particulate component.

3. The method as claimed in claim 1 wherein the second, pre-formed detergent component is of circular or polygonal cross-section.

4. The method as claimed in claim 1 wherein the second, pre-formed detergent component is of uniform or essentially uniform cross-section throughout its depth.

5. The method as claimed in claim 1 wherein (i) is effected by a vacuum thermoforming process.

6. The method as claimed in claim 1 wherein in (iii) the particulate first detergent composition is compacted.

7. The method as claimed in claim 1 wherein the film used in (i) has a lower modulus value than that used in (v).

8. The method as claimed in claim 1 wherein the water-soluble synthetic plastics film used in (i) is a cast film and the water-soluble film used as a seal in (v) is a blown film.

9. The method as claimed in claim 8 wherein the at least substantially planar surface of the second detergent component is bounded by an edge, and wherein in the resulting dosage form detergent component the blown film is in contact with said edge to assist in preventing movement of the first particulate component.

10. The method as claimed in claim 1 wherein the synthetic plastics films employed in (i) and (v) have a thickness of 25 to 80 μm.

11. The method as claimed in claim 1 wherein the synthetic films used in (i) and (v) comprise polyvinyl alcohol.

12. The method as claimed in claim 1 wherein the second detergent component has a thickness which is equal to, or greater than, the depth of the recess.

13. The method as claimed in claim 1 wherein the dosage form product produced has a flat or essentially flat base.

14. The method as claimed in claim 1 wherein the first, particulate detergent component is such that, when used to produce a dosage form detergent product results in a dosage form detergent product having a strength of greater than 4.5 N as measured by an end-to-end crush test.

15. The method as claimed in claim 14 wherein said strength is greater than 6 N.

16. The method as claimed in claim 1 wherein the dosage form detergent product produced is for laundry washing.

17. The method as claimed in claim 1 wherein the dosage form detergent product produced is for use in an automatic dishwashing machine.

18. A method of producing a dosage form detergent product, comprising the sequence of:

(i) producing an open-mouthed pouch by forming a water-soluble, synthetic plastics film into a mould cavity defining said pouch, (ii) introducing a particulate first detergent composition into the pouch, (iii) forming a recess in the upper surface of the particulate first detergent composition, said forming being effected by a punch tool having a protuberance and a surrounding area for compacting the first detergent composition, (iv) introducing into said recess an insert consisting of a pre-formed, shape-retaining second compressed particulate detergent component with an at least substantially planar face positioned to be exposed from the particulate first detergent component, said second, pre-formed detergent component being in contact with the first detergent component, and (v) positioning a water-soluble film over the insert and sealing the water-soluble film over the mouth of the pouch and against said exposed face of the pre-formed detergent product, wherein any compaction pressure used in production of the product is insufficiently high so that the particulate first detergent composition is compacted to a mass which would not be shape-retaining if the water soluble film of the product were to be removed, and wherein subsequent to (v) the sealing film is pierced.

* * * * *